US009638088B1

(12) United States Patent
Shoshi et al.

(10) Patent No.: US 9,638,088 B1
(45) Date of Patent: May 2, 2017

(54) NOISE ARRESTING SYSTEM

(71) Applicants: Jeton Shoshi, Ft. Lauderdale, FL (US); Arben Shoshi, Ft. Lauderdale, FL (US)

(72) Inventors: Jeton Shoshi, Ft. Lauderdale, FL (US); Arben Shoshi, Ft. Lauderdale, FL (US)

( * ) Notice: Subject to any disclaimer, the term of this patent is extended or adjusted under 35 U.S.C. 154(b) by 0 days.

(21) Appl. No.: 15/041,124

(22) Filed: Feb. 11, 2016

(51) Int. Cl.
*F01N 1/02* (2006.01)
*F01N 13/08* (2010.01)

(52) U.S. Cl.
CPC ..... *F01N 13/082* (2013.01); *F01N 1/02* (2013.01)

(58) Field of Classification Search
CPC ..... F01N 13/082; F01N 1/02
USPC ..... 181/231, 240, 268
See application file for complete search history.

(56) References Cited

U.S. PATENT DOCUMENTS 3,987,867 A 10/1976 Moller
4,119,174 A 10/1978 Hoffman
4,424,882 A 1/1984 Moller
D345,167 S 3/1994 Lee
5,869,793 A 2/1999 Berger et al.
5,916,128 A * 6/1999 Garr ..... F01N 3/2885 60/274
6,164,066 A * 12/2000 Sakaguchi ..... F01N 1/089 181/231
6,467,569 B2 10/2002 Noe et al.
6,591,935 B1 * 7/2003 Petley ..... F01N 13/02 180/309
2002/0088666 A1 * 7/2002 Bouffard ..... F01N 1/088 181/231
2004/0099475 A1 * 5/2004 Schulte ..... F01N 13/082 181/227
2005/0061578 A1 * 3/2005 Schulte ..... F01N 13/082 181/227
2009/0101434 A1 * 4/2009 Sammut ..... F01N 1/006 181/227

* cited by examiner

*Primary Examiner* — Jeremy Luks

(57) ABSTRACT

A noise arresting system includes a landscape maintenance implement that has an internal combustion engine and the internal combustion engine has an exhaust. A resonator has a first end, a second end and a peripheral wall extending therebetween. The first end and the second end each is open and the resonator is substantially hollow. An intake pipe is insertably positioned within the first end. The intake pipe is fluidly coupled to the exhaust to reduce a sound level of the exhaust. An exhaust pipe has a primary end, a secondary end and a flexible section extending between the primary end and the secondary end. The primary end is insertably positioned within the second end. The flexible section is bendable to direct the secondary end away from the resonator at a selected angle.

4 Claims, 3 Drawing Sheets

NOISE ARRESTING SYSTEM

BACKGROUND OF THE DISCLOSURE

Field of the Disclosure

The disclosure relates to noise arresting devices and more particularly pertains to a new noise arresting device for reducing a noise level of a landscape maintenance implement.

SUMMARY OF THE DISCLOSURE

An embodiment of the disclosure meets the needs presented above by generally comprising a landscape maintenance implement that has an internal combustion engine and the internal combustion engine has an exhaust. A resonator has a first end, a second end and a peripheral wall extending therebetween. The first end and the second end each is open and the resonator is substantially hollow. An intake pipe is insertably positioned within the first end. The intake pipe is fluidly coupled to the exhaust to reduce a sound level of the exhaust. An exhaust pipe has a primary end, a secondary end and a flexible section extending between the primary end and the secondary end. The primary end is insertably positioned within the second end. The flexible section is bendable to direct the secondary end away from the resonator at a selected angle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
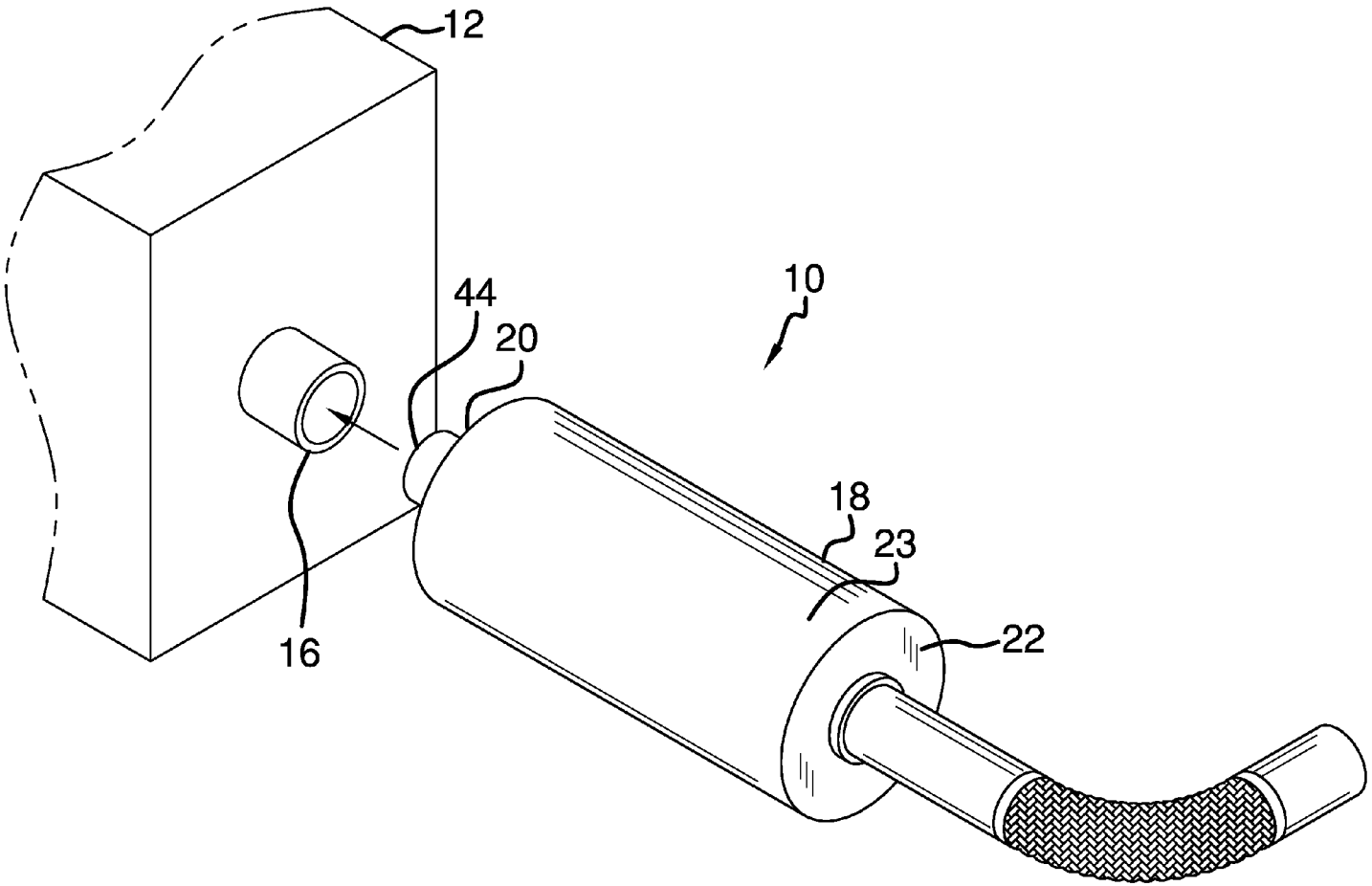
FIG. 1 is a perspective view of a noise arresting system according to an embodiment of the disclosure.
Figure 2:
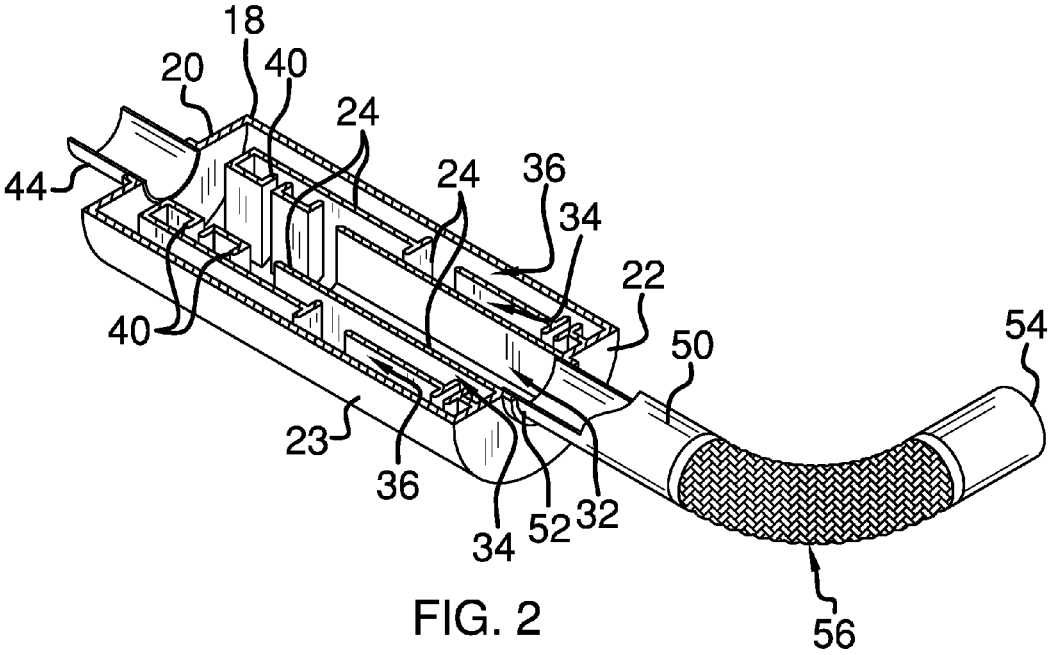
FIG. 2 is a top perspective cutaway view of an embodiment of the disclosure.
Figure 3:
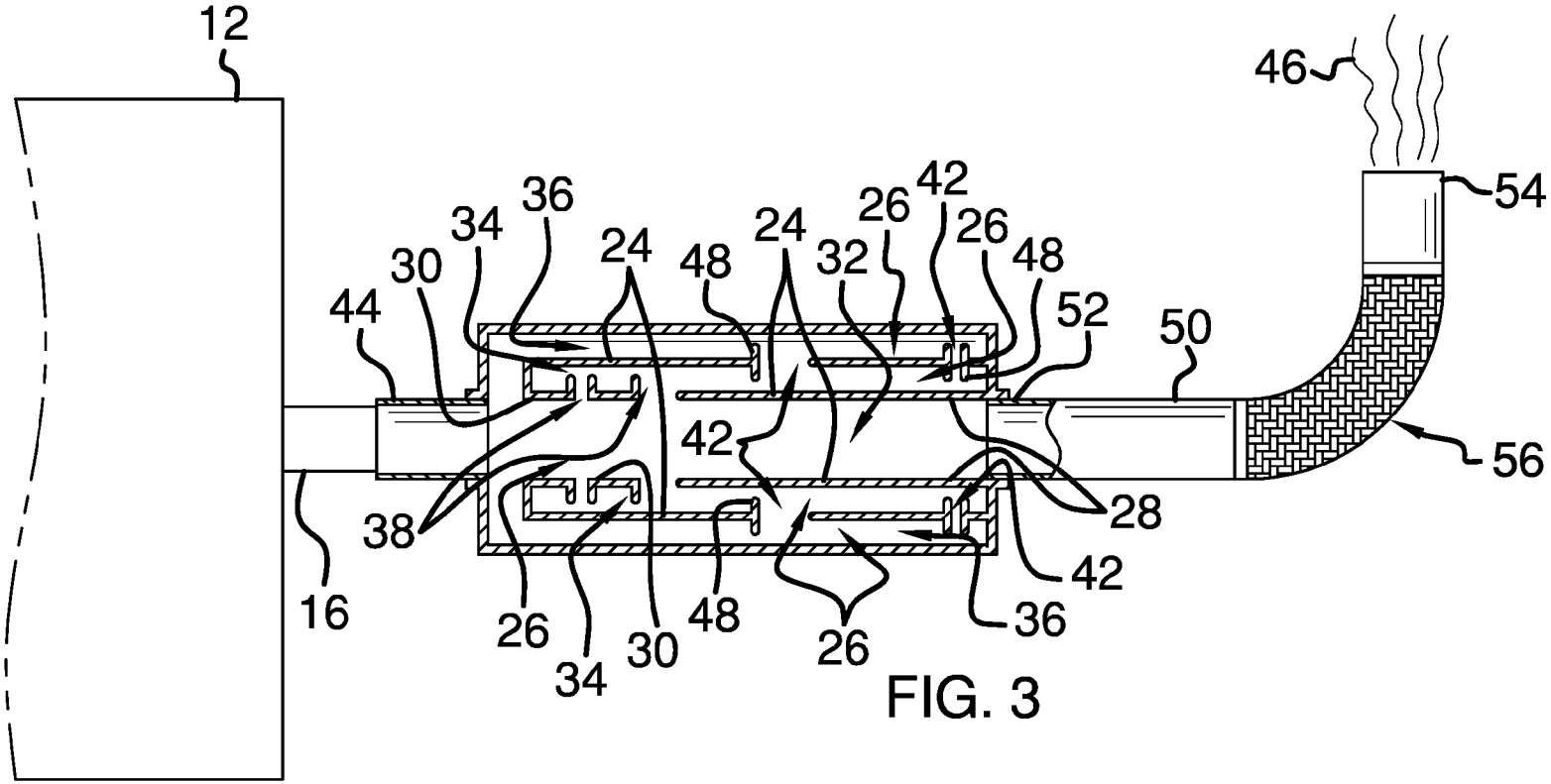
FIG. 3 is a top cutaway view of an embodiment of the disclosure.

With reference now to the drawings, and in particular to FIGS. 1 through 3 thereof, a new noise arresting device embodying the principles and concepts of an embodiment of the disclosure and generally designated by the reference numeral 10 will be described.

As best illustrated in FIGS. 1 through 3, the noise arresting system 10 generally comprises a landscape maintenance implement 12 that has an internal combustion engine 14 and the internal combustion engine 14 has an exhaust 16. The landscape maintenance implement 12 may be a leaf blower or the like. The internal combustion engine 14 may be a two-stroke engine of any conventional design.

A resonator 18 is provided that has a first end 20, a second end 22 and a peripheral wall 23 extending therebetween. The first end 20 and the second end 22 are each open and the resonator 18 is substantially hollow. The resonator 18 has a plurality of dividers 24 positioned within an interior of the resonator 18. The dividers 24 extend between the second end 22 and a point closer to the first end 20 than the second end 22. Moreover, the dividers 24 are spaced apart to define a plurality of intersecting channels 26 within the interior of the resonator 18. The dividers 24 may comprise a pair of interior dividers 28 and a pair of exterior dividers 30.

The pair of interior dividers 28 define a central channel 32 extending between the first end 20 and the second end 22. The pair of exterior dividers 30 are positioned between the interior dividers 28 and the peripheral wall 23. The exterior dividers 30 define a pair of interior channels 34 positioned between one of the interior 28 and exterior 30 dividers and a pair of exterior channels 36 positioned between one of the exterior dividers 30 and the peripheral wall 23.

The interior dividers 28 each may have a pair of slots 38 extending therethrough. The slots 38 are positioned proximate the first end 20 and the slots 38 place the central channel 32 in fluid communication with the interior channels 34. Additionally, the slots 38 define a spark arrestor 40 in each of the interior dividers 28 to prevent a spark from the internal combustion engine 14 from being released from the resonator 18. The pair of exterior dividers 30 may each have a pair of openings 42 extending therethrough. The openings 42 place each of the interior channels 34 in fluid communication with one of the exterior channels 36.

An intake pipe 44 is provided and is positioned within the first end 20. Consequently, the intake pipe 44 is in fluid communication with the intersecting channels 26. The intake pipe 44 is fluidly coupled to the exhaust 16 to direct combustion gasses 46 from the internal combustion engine 14 into the intersecting channels 26. A plurality of baffles 48 are positioned within each of the interior 34 and exterior 30 channels. The baffles 48 disrupt a flow of the combustion gasses 46 through the interior 34 and exterior 30 channels. The interior 34 and exterior 30 channels and the baffles 48 serve to dissipate sound waves generated by the combustion gasses 46. The sound waves may be reduced to a sound pressure level between 50 dB and 70 dB.

An exhaust pipe 50 has a primary end 52 and a secondary end 54. The exhaust pipe 50 has a flexible section 56 extending between the primary end 52 and the secondary end 54. The flexible section 56 may be comprised of a metallic mesh or the like. The primary end 52 is insertably positioned within the second end 22 such that the exhaust pipe 50 is in fluid communication with the intersecting channels 26. The flexible section 56 is bendable such that the secondary end 54 is directed away from the resonator 18 at a selected angle. The flexible section 56 is resistant to bending, but not resilient such that it remains at the selected angle.

In use, the intake pipe 44 is fluidly coupled to the exhaust 16 on the internal combustion engine 14. The flexible section 56 is bent to position the secondary end 54 at the selected angle. As the combustion gasses 46 pass through the central channel 32, the interior channels 34 and the exterior channels 36, the resonator 18 reduces a sound level of the internal combustion engine 14 in order to minimize noise pollution of the immediate environment. Additionally, the flexible section 56 of the exhaust pipe 50 allows the combustion gasses 46 to be directed in a selected direction.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A noise arresting system configured to reduce the noise of a landscape maintenance implement, said system comprising:

a landscape maintenance implement having an internal combustion engine, said internal combustion engine having an exhaust;

a resonator having a first end, a second end and a peripheral wall extending therebetween, said first end and said second end each being open, said resonator being substantially hollow;

an intake pipe, said first end having said intake pipe insertably positioned therein, said intake pipe being fluidly coupled to said exhaust to reduce a sound level of said exhaust; and an exhaust pipe having a primary end and a secondary end, said exhaust pipe having a flexible section extending between said primary end and said secondary end, said second end having said primary end insertably positioned therein, said flexible section being bendable such that said secondary end is directed away from said resonator at a selected angle wherein said resonator has a plurality of dividers positioned within an interior of said resonator, said dividers extending between said first end and said second end, said dividers being spaced apart to define a plurality of intersecting channels within said interior of said resonator.

2. The assembly according to claim 1, wherein said intake pipe is in fluid communication with said intersecting channels such that said intake pipe is configured to direct combustion gasses from said internal combustion engine into said intersecting channels, said intersecting channels reducing a sound level of the combustion gasses when the combustion gasses are expelled from said exhaust.

3. The assembly according to claim 1, wherein said exhaust pipe is in fluid communication with said intersecting channels.

4. A noise arresting system configured to reduce the noise of a landscape maintenance implement, said system comprising:

a landscape maintenance implement having an internal combustion engine, said internal combustion engine having an exhaust;

a resonator having a first end, a second end and a peripheral wall extending therebetween, said first end and said second end each being open, said resonator being substantially hollow, said resonator having a plurality of dividers positioned within an interior of said resonator, said dividers extending between said first end and said second end, said dividers being spaced apart to define a plurality of intersecting channels within said interior of said resonator;

an intake pipe, said first end having said intake pipe insertably positioned therein such that said intake pipe is in fluid communication with said intersecting channels, said intake pipe being fluidly coupled to said exhaust such that said intake pipe is configured to direct combustion gasses from said internal combustion engine into said intersecting channels, said intersecting channels reducing a sound level of the combustion gasses when the combustion gasses are expelled from said exhaust; and an exhaust pipe having a primary end and a secondary end, said exhaust pipe having a flexible section extending between said primary end and said secondary end, said second end having said primary end insertably positioned therein such that said exhaust pipe is in fluid communication with said intersecting channels, said flexible section being bendable such that said secondary end is directed away from said resonator at a selected angle.

* * * * *